US006511561B1

(12) United States Patent
Kohlhammer et al.

(10) Patent No.: US 6,511,561 B1
(45) Date of Patent: Jan. 28, 2003

(54) FIBER BINDING POWDER COMPOSITION FOR CONSOLIDATING FIBER MATERIALS

(75) Inventors: Klaus Kohlhammer, Marktl (DE); Gerhard Koegler, Burgkirchen (DE); Susanne Seidl, Toeging (DE); Sabine Gruber, Tittmoning (DE); Herbert Proebstl, Braunau (AT)

(73) Assignee: Wacker-Chemie GmbH, Munich (DE)

( * ) Notice: Subject to any disclaimer, the term of this patent is extended or adjusted under 35 U.S.C. 154(b) by 0 days.

(21) Appl. No.: 09/336,272

(22) Filed: Jun. 18, 1999

(30) Foreign Application Priority Data

Jun. 19, 1998 (DE) ..... 198 27 475

(51) Int. Cl.[7] ..... B32B 31/00

(52) U.S. Cl. ..... 156/62.2; 156/296; 525/56; 525/61

(58) Field of Search ..... 525/56, 61; 156/62.2, 156/296

(56) References Cited

U.S. PATENT DOCUMENTS

| | | | | |
|---|---|---|---|---|
| 3,112,235 A | * | 11/1963 | Blanchard | 156/310 |
| 3,438,808 A | * | 4/1969 | Hawkins et al. | |
| 3,689,314 A | * | 9/1972 | Duchane | |
| 5,399,422 A | * | 3/1995 | Dijkema et al. | |
| 5,668,216 A | | 9/1997 | Kinkel et al. | |
| 5,777,015 A | | 7/1998 | Jakob et al. | |
| 5,907,011 A | | 5/1999 | Jakob et al. | |

FOREIGN PATENT DOCUMENTS

| | | | |
|---|---|---|---|
| AU | 366 59 89 | | 4/1990 |
| DE | 2 261 402 | | 7/1974 |
| DE | 44 31 343 | | 3/1996 |
| DE | 195 45 608 | A1 | 6/1997 |
| EP | 0 721 004 | A2 | 7/1996 |
| EP | 0 687 317 | B1 | 11/1996 |
| EP | 0 829 509 | | 3/1998 |
| GB | 1 440 337 | | 6/1976 |
| JP | 51-125446 | A * | 11/1976 |
| JP | 61-236866 | A * | 10/1986 |
| WO | WO90 144 57 | A1 | 11/1990 |
| WO | WO94 20 661 | | 9/1994 |

OTHER PUBLICATIONS

Derwent Abstract corresponding to EP–A 0829509 (AN 1998–161334).

Derwent Abstract corr. to DE 19545608 (AN 1997–300323).

Fox T.G., Bull. Am. Physics Soc., 1, 3, p. 123, (1956).

Polymer Handbook, 3rd Edition, J. Wiley & Sons, New York, (1989).

* cited by examiner

*Primary Examiner*—Jeff H. Aftergut
(74) *Attorney, Agent, or Firm*—Brooks & Kushman P.C.

(57) ABSTRACT

Disclosed is a fiber binding powder composition for consolidating fiber materials, comprising a) a polymer powder based on a polyvinyl alcohol stabilized polymer of one or more monomers selected from the group consisting of the vinyl esters of branched or unbranched carboxylic acids having 1 to 12 carbon atoms, the esters of acrylic acid and methacrylic acid with branched or unbranched alcohols having 1 to 12 carbon atoms, aromatic vinyl compounds, vinyl halides, olefins and dienes, and b) an inorganic compound which is solid at room temperature and which enters a chemical bond with the OH groups of the polyvinyl alcohol on introduction of said powder into water.

17 Claims, No Drawings

FIBER BINDING POWDER COMPOSITION FOR CONSOLIDATING FIBER MATERIALS

TECHNICAL FIELD

This invention relates to fiber binding powder compositions for consolidating fiber materials and to consolidating processes utilizing said fiber binding powder compositions.

BACKGROUND OF THE INVENTION

Textile sheet materials produced by the usual methods for producing nonwovens as, for example, the air laid, wet laid or spun laid processes require a binding agent to durably fix the fibers and to increase the resistance to mechanical stress. These binding agents are usually based on synthetic, macromolecular compounds and, according to the prior art, they can be applied in the form of solids, for example as powders, granules or fibers, or in the form of liquids such as, for example, aqueous polymer dispersions or solutions. The increased strength of the nonwovens is the result of the fibers becoming bound by the polymers, which adhere to the fiber and thus strengthen the fibrous structure.

When the fibers are laid down by means of a wet laid process, it is frequently desirable to incorporate the binding agent together with the fibers into the aqueous slurry. In this case, the binder system has to meet special requirements. First, the binding agent should be very finely dispersible in the water together with the fibers, in which case the dispersing or the suspending of the generally particulate binder in the water is of particular concern. Secondly, the binder should possess very good fiber adhesion, even in the aqueous liquor, in order that it may not be washed out along with the aqueous liquor in the course of laying down the fibers. Since at elevated temperatures, the glass transition temperature or the melt temperature of the binding agents are often exceeded, there is a need for durable chemical crosslinking of the binding agents in order that the fibrous structures may be provided with dimensional stability even at relatively high temperatures. For this reason, the binding agent should, via a chemical crosslinking reaction, ensure durable fixing of the fibers within the textile sheet material. Such properties are especially of advantage with regard to the prebinding of wet laid glass fibers.

WO-A 90/14457 discloses a method of processing wherein glass fibers, following a carding step, are mixed with thermoplastic powder, for example powders of polypropylene, polyester or polyamide, and the fibrous structure is then consolidated at elevated temperature and under pressure. The wet laid process is said to be inadvisable because of the risk of the binding agent being washed off. AU-B 36659/89 likewise describes consolidating glass fiber materials by means of thermoplastic powders. The use of polyesters or polystyrene is recommended. However, this binder system is not applicable to a wet laid process. In particular, for instance, the low strength of thus-bound fibrous structures on contact with water or solvents is extremely disadvantageous.

Self crosslinking redispersible dispersion powders based on vinyl ester copolymers or (meth)acrylic ester copolymers useful as fiber binding agents are described in EP-B 687317 (U.S. Pat. No. 5,668,216). The disadvantage with this binder system is its relatively high redispersibility in aqueous systems. Consequently, during fiber lay down, the binder is washed out of the aqueous liquor and is thus no longer available for fiber binding.

EP-A 721004 discloses crosslinkable, water-dispersible powders for use in polymer films and coatings, these powders comprising both film forming polymers having at least one functional group and reactive compounds that form a nonionic chemical bond with one another after dispersion in water. More particularly, this polymer mixture is useful for coating applications after dispersion of the binding agent in water. There is no mention in this patent application of any utility with regard to fiber binding in nonwovens. The disadvantage with these binding systems is their high redispersibility in water, as a consequence of which the binder is washed out in the course of the wet laid process before it has a chance to bond to the fibers.

Water redispersible polymer powders for use in adhesives and chemical products for construction are known from DE-A 19545608. The powders are stabilized with polyvinyl alcohol and comprise water soluble, bifunctional, masked aldehydes as a crosslinker component. The unmasking of the aldehyde function may optionally be promoted by the addition of Brönstedt and Lewis acids.

SUMMARY OF THE INVENTION

It is an object of the present invention to provide binding agents for the consolidation of wet laid fiber materials, especially glass fibers, which binding agents can be introduced together with the fibers into the aqueous liquor and, after lay down of the fibers, will ensure durable consolidation of the fibrous sheet material. It is a further object of the present invention to develop a binding agent in powder form which can be mixed and laid down with fibers in a dry process (air laid, carded) and then be activated by a moistening step (dipping, padding, steaming) as a binder to ensure durable consolidation of the textile sheet material.

This object is achieved by the development of a binding agent which is suspendible in aqueous slurry and is based on a dry, pulverulent, thermoplastic polymer preparation which in turn is based on the one hand on a polyvinyl alcohol stabilized polymer and on the other on a reactive component capable of entering a permanent chemical bond with polyvinyl alcohol.

DESCRIPTION OF THE PREFERRED EMBODIMENTS

The present invention accordingly provides a fiber binding powder composition for consolidating fiber materials, comprising a) a polymer powder based on a polyvinyl alcohol stabilized polymer of one or more monomers selected from the group consisting of the vinyl esters of branched or unbranched carboxylic acids having 1 to 12 carbon atoms, the esters of acrylic acid and methacrylic acid with branched or unbranched alcohols having 1 to 12 carbon atoms, aromatic vinyl compounds, vinyl halides, olefins and dienes, and b) an inorganic compound which is solid at room temperature (23° C.) and which enters into a chemical bond with the OH groups of the polyvinyl alcohol on introduction of said powder into water.

Preferred vinyl esters are vinyl acetate, vinyl propionate, vinyl butyrate, vinyl 2-ethylhexanoate, vinyl laurate, 1-methylvinyl acetate, vinyl pivalate and vinyl esters of alpha branched monocarboxylic acids having 9 to 11 carbon atoms, for example with VeoVa9$^R$ and VeoVa10$^R$ (tradenames of Shell). Vinyl acetate is particularly preferred.

Preferred methacrylic esters or acrylic esters are methyl acrylate, methyl methacrylate, ethyl acrylate, ethyl methacrylate, propyl acrylate, propyl methacrylate, n-butyl acrylate, n-butyl methacrylate, 2-ethylhexyl acrylate. Particular preference is given to methyl acrylate, methyl methacrylate, n-butyl acrylate and 2-ethylhexyl acrylate.

Preferred aromatic vinyl compounds are styrene, methylstyrene and vinyltoluene. A preferred vinyl halide is vinyl chloride. The preferred olefins are ethylene and propylene, and the preferred dienes are 1,3-butadiene and isoprene.

Optionally, the polymer may further contain 0.05 to 10.0% by weight, based on the total weight of the monomers, of comonomers selected from the group consisting of ethylenically unsaturated mono- and dicarboxylic acids and their amides, such as acrylic acid, methacrylic acid, maleic acid, fumaric acid, itaconic acid, acrylamide, methacrylamide; ethylenically unsaturated sulfonic acids and their salts, preferably vinylsulfonic acid, 2-acrylamidopropanesulfonate and N-vinylpyrrolidone. Further examples of comonomers in the stated amounts are alkoxysilane functional monomers such as acryloyloxypropyltri(alkoxy)- and methacryloyloxypropyltri(alkoxy)-silanes, vinyltrialkoxysilanes and vinylmethyldialkoxysilanes, preferably vinyltriethoxysilane and gamma-methacryloyloxypropyltriethoxysilane. Also suitable are co-crosslinkers such as acrylamidoglycolic acid (AGA), methyl methacrylamidoglycolate (MAGME), -methylolacrylamide (NMA), N-methylolmethacrylamide (NMMA), N-methylolallyl carbamate, alkyl ethers of N-methylolacrylamide or N-methylolmethacrylamide and also their isobutoxy ethers or n-butoxy ethers.

The polymer composition is generally chosen so as to result in the polymer having a glass transition temperature, Tg, of −40° C. to +90° C. The glass transition temperature, Tg, of the polymers can be determined in known manner by means of differential scanning calorimetry (DSC). The Tg can also be approximately predicted by means of the Fox equation. According to T. G. Fox, Bull. Am. Physics Soc. 1, 3, page 123 (1956): $1/Tg=x_1/Tg_1+x_2/Tg_2+ \ldots +x_n/Tg_n$, where $x_n$ is the mass fraction (% by weight/100) of monomer n and $Tg_n$ is the glass transition temperature in degrees Kelvin of the homopolymer of said monomer n. Tg values of homopolymers are recited in Polymer Handbook 3rd Edition, J. Wiley & Sons, New York (1989).

Preference is given to the polymers described below, for which the stated weight percentages, optionally including the comonomer content, add up to 100% by weight:

From the group of the vinyl ester polymers: vinyl acetate polymers; vinyl acetate-ethylene copolymers having an ethylene content of 1 to 60% by weight; vinyl ester-ethylene-vinyl chloride copolymers having an ethylene content of 1 to 40% by weight and a vinyl chloride content of 20 to 90% by weight, the vinyl ester preferably comprising vinyl acetate and/or vinyl propionate and/or one or more copolymerizable vinyl esters such as vinyl laurate, vinyl pivalate, vinyl 2-ethylhexanoate, vinyl esters of an alpha-branched carboxylic acid, especially vinyl versatate (VeoVa9$^R$, VeoVa10$^R$, VeoVa11$^R$); vinyl acetate copolymers with 1 to 50% by weight of one or more copolymerizable vinyl esters such as vinyl laurate, vinyl pivalate, vinyl 2-ethylhexanoate, vinyl esters of an alpha-branched carboxylic acid, especially vinyl versatate (VeoVa9$^R$, VeoVa10$^R$, VeoVa11$^R$), which optionally additionally contain 1 to 40% by weight of ethylene; vinyl ester-acrylic ester copolymers containing 30 to 90% by weight of vinyl esters, especially vinyl acetate, and 1 to 60% by weight of acrylic ester, especially n-butyl acrylate or 2-ethylhexyl acrylate, which optionally additionally contain 1 to 40% by weight of ethylene; vinyl ester-acrylic ester copolymers containing 30 to 75% by weight of vinyl acetate, 1 to 30% by weight of vinyl laurate or vinyl ester of an alpha branched carboxylic acid, especially vinyl versatate, 1 to 30% by weight of acrylic ester, especially n-butyl acrylate or 2-ethylhexyl acrylate, which optionally additionally contain 1 to 40% by weight of ethylene.

From the group of the (meth)acrylic polymers: polymers of n-butyl acrylate or 2-ethylhexyl acrylate; copolmers of methyl methacrylate with n-butyl acrylate and/or 2-ethylhexyl acrylate.

From the group of the vinyl chloride polymers: as well as the abovementioned vinyl ester-vinyl chloride-ethylene copolymers, vinyl chloride-ethylene copolymers and vinyl chloride-acrylate copolymers.

From the group of the styrene polymers: styrene-butadiene copolymers and styrene-acrylic ester copolymers such as styrene-n-butyl acrylate or styrene-2-ethylhexyl acrylate having a styrene content of 10 to 70% by weight in each case.

The preparation of the polymers is performed in a conventional manner by the emulsion polymerization process and subsequent drying of the aqueous polymer dispersions obtained thereby, for example by means of spray drying according to the procedure described in EP-B 687317, which is incorporated herein by reference.

The polymers are stabilized using partially hydrolyzed or fully hydrolyzed polyvinyl alcohol, preferably partially hydrolyzed polyvinyl alcohols having a degree of hydrolysis of 75 to 99 mol % and a Höppler viscosity (4% strength aqueous solution, DIN 532015, Höppler method at 20° C.) of 1 to 60 mPas, preferably 4 to 35 mPas. In general, the polyvinyl alcohol fraction ranges from 1 up to 30% by weight, based on the polymer. The polyvinyl alcohol fraction can be added during the polymerization or not until the polymerization has ended, i.e., before or during spray drying.

The inorganic compound b) is selected from the group consisting of water-soluble compounds of boron, aluminum, chromium and zirconium which are pulverulent at room temperature and whose solubility in water under standard conditions is not less than 1 g per liter of water. Examples are boric acid, borax, boric acid complexes, aluminum nitrate, aluminum chloride, zirconium oxychloride and zirconium acetate. Preference is given to boric acid ($B(OH)_3$), borax ($Na_2B_4O_7x10H_2O$) and also boric acid complexes with bivalent and more highly valent ligands, for example with aliphatic and alicyclic polyols, such as the boric acid complexes with pentaerythritol and tartaric acid.

The amount of reactive inorganic component b) depends on the degree of crosslinking desired for the polyvinyl alcohol. The amount used is generally 0.1 to 30% by weight, preferably 1 to 15% by weight, each percentage based on the total weight of the fiber binding powder composition.

The fiber binding powder compositions may optionally further include pigments, antioxidants, dyes, plasticizers, buffers, film forming aids, fillers, flame retardants, foam forming aids, foam inhibitors, wetting agents, thermosensitizers, antistats, biocides and hand improvers in customary amounts. Preference is given to including pulverulent, water soluble substances as pH buffers in the compositions.

The fiber binding powder composition is useful for consolidating natural and synthetic fiber materials. There is no a priori restriction with regard to the choice of fiber materials; all fiber raw materials which are used in the nonwovens industry are contemplated, for example polyester, polyamide, polypropylene, polyethylene, glass, ceramic, viscose, carbon, cellulose, cotton, wool and wood fibers. Preference is given to polyester, polyamide, glass, cellulose, cotton, wool and wood fibers. The fiber materials can be used in the form of fiber, yarn, mat, laid scrim or woven textiles (wovens).

The fiber binding powder composition can be used in wet laid processes, in dry laid processes with subsequent moistening, and for laminating fiber materials. Components a) and b) of said fiber binding powder composition are added mixed or separately to the fiber material. In the wet laid or dry laid process, useful amounts of fiber binding agent are preferably between 1 to 50% by weight, more preferably 5 to 30% by weight, in each case based on the total weight of the textile sheet material. For lamination, the add-on weights are generally within the range from 1 to 1000 g/m$^2$, preferably within the range from 5 to 100 g/m$^2$ and particularly preferably within the range from 10 to 50 g/m$^2$.

In preferred embodiments, the fiber binding powder composition is utilized in processes for binding fiber materials wherein A) the fiber binding powder composition and the fiber material are suspended in water, then laid down to form a textile sheet material and the sheet materials thus obtained are optionally dried and thermally consolidated by heat treatment;

B) the fiber binding powder composition and the fiber material are dry mixed, the mixture is suspended in water and then laid down to form a textile sheet material, and the sheet materials thus obtained are dried and optionally thermally consolidated by heat treatment;

C) the fiber binding powder composition and the fiber material are dry mixed, the mixture is subsequently laid down dry to form a textile sheet material and moistened with water, or the fiber binding powder composition is sprinkled into the laid out fiber material and moistened with water, and the sheet materials thus obtained are dried by heat treatment, and optionally thermally consolidated;

D) the fiber material is spread out in the form of a sheet and besprinkled with the fiber binding powder composition, then moistened and laminated to a second substrate, optionally through the aid of elevated temperature and/or elevated pressure.

In the wet laid process variant A) the fibers and the fiber binding powder composition, or the individual components of the fiber binding powder composition, are suspended in water in any order in a continuous or batchwise manner. The suspending of the fibers may optionally be effected with the assistance of ionic or nonionic surfactants. Preference is given to processes wherein the fibers and the components of the fiber binding powder composition are batchmixed with water in a stirred tank to form a masterbatch and optionally adjusted with further additives to a given property profile. The suspension, having a solids content of preferably 0.01 to 5% by weight, is then, laid down to form a sheetlike structure in a wet laid process, preferably in a continuous process.

In the wet laid process variant B) the fibers and the components of the fiber binding powder composition are dry mixed continuously or in individual batches by mechanical mixing or by mixing in a turbulent air stream, following which this dry mix is suspended in water, optionally with the assistance of ionic or nonionic surfactants. The suspension, having a solids content of preferably 0.01 to 5% by weight, is then, laid down to form a sheetlike structure in a wet laid process, again, preferably continuously.

If the fiber binding powder composition is used in the dry laid process as per variant C), the fibers and the components of the fiber binding powder composition are continuously or batch dry mixed by mechanical mixing or in a turbulent air stream. The mixture is then laid down to form a textile sheet material in a dry laid process, for example an air laid process or carding process. Also suitable are continuous air laid processes wherein a preformed, unbound web is besprinkled with the fiber binding powder composition, then reopened and again subjected to an aerodynamic webbing process. Another possibility is the carding of fibers on a carding machine to form a web, followed by besprinkling of this web with the fiber binding powder composition and the transportation of the sprinkled powder into the interior of the web by means of needle punching. Optionally, the web thus carded can also be superposed by a cross-layer to form a thicker web.

The fibrous structures laid out by means of the various versions of the dry laid process are subsequently moistened with liquid or vaporous water to activate the fiber binding powder. In general, the moistening is effected with 5 to 60% by weight, preferably 10 to 35% by weight, of water, in each case based on the total weight of fiber and powder. The moistening can be effected by means of water vapor or else by means of saturating, dipping, spraying and padding, and optionally combinations of the individual processes. Thick web materials are preferably steamed. It is also possible to proceed by dry laying out, together with the fibers, only one component of the fiber binding powder composition, preferably component a), and adding the other component, preferably component b), during the moistening, in the form of a solution in water.

In all process variants A) to C), the drying and consolidating of the fiber material generally takes place at temperatures of 80° C. to 260° C., preferably 120° C. to 200° C., optionally under a pressure of up to 100 bar, in which case the drying temperature and the pressure to be employed depend primarily on the nature of the fiber material.

For lamination, the fibers or fibrous fabrics such as wovens and nonwovens such as laid scrim are spread out flat and besprinkled with the fiber binding powder composition areawise, dotwise or patternwise. The binder is activated by moistening in the abovementioned manner and then a further substrate is placed on top. The laminates are likewise consolidated under the above-specified temperature and pressure conditions.

Useful substrates include wovens and nonwovens such as glass fiber wovens and glass fiber webs, plastic films such as polyester films or corona treated polyolefin films, woodfiber board such as hardchipboard or medium density fiber (MDF) board, foamed sheetlike materials such as polyurethane foams and polyvinyl alcohol foams.

It is possible to laminate two identical or different sheetlike fibrous structures. Examples are acoustical insulation mats in automotive engineering which are composed of cotton shoddy, and which are durably laminated with a cover sheet. It is similarly possible to adhere fibrous structures to nonfibrous substrates. Examples are the adhering of glass fibers onto decorative surface films or panels in the sector of building insulation or the adhesive binding of wovens to leather in the shoe industry.

The claimed fiber binding powder composition comprises two inherently reactive components side by side in solid form in such an advantageous manner that they are infinitely storable in that form and are activated only on contact with water. The reaction initiated in an aqueous environment is spontaneous and rapid. Unlike the powders discussed in the review of the related art, the fiber binding powder composition of the invention immediately undergoes crosslinking on being suspended in water. Moreover, in the polymer of the invention, it is the crosslinking reaction with the protective colloids at the particle surface which takes place and not the significantly slower reaction with the functional groups in the particle interior.

Surprising aspects are the good suspendibility or dispersibility of the fiber binding powder composition in water and also the uniform distribution of the binding powder on the fiber surface. Both effects are surprising because, owing to the rapid crosslinking reaction between the two components present in the powder preparation, one would have expected clumping to take place on contact with water.

Embodiments of the invention will now be more particularly described by way of example.

The binding of glass fibers with fiber binding powder was investigated in a wet laid process:

Web Production 0.03 g of a cationic surfactant (Dehyquart SP) was weighed into a glass beaker by means of a pipette and then admixed with 200 g of water. The surfactant solution was stirred at 600 rpm, and 1.0 g of glass fiber was added. After about 1 minute of stirring, the stirring speed of the glass fiber suspension was raised to 800 rpm. The two components a) and b) of the fiber binding powder composition were then added and stirred in for 15 minutes. The pH of the suspension was measured. On completion of the stirring time the glass fiber suspension was collected on a Perlon sieve. The wet glass fiber web was placed in an aluminum dish and dried at 150° C. for 3 hours.

The following powders were used as component a):

Polymer Powder 1 vinyl acetate polymer with 1% by weight of N-methylolacrylamide, stabilized with 8% by weight of polyvinyl alcohol (Höppler viscosity 25 mPas; degree of hydrolysis 92%).

Polymer Powder 2 ethylene-vinyl acetate copolymer with 15% by weight of ethylene, stabilized with 11% by weight of polyvinyl alcohol (Höppler viscosity 4 mPas; degree of hydrolysis 82%).

Polymer Powder 3 vinyl acetate homopolymer stabilized with 11% by weight of polyvinyl alcohol (Höppler viscosity 4 mPas; degree of hydrolysis 82%).

Polymer Powder 4 vinyl acetate polymer with 1% by weight of N-methylolacrylamide, stabilized with 8% by weight of polyvinyl alcohol (Höppler viscosity 56 mPas; degree of hydrolysis 98%).

Polymer Powder 5 polyvinyl acetate powder with masked aldehydes (glutaraldehyde bis(sodium bisulfite) similar to DE-A 19545608.

Polymer Powder 6 emulsifier stabilized, carboxyl containing styrene-acrylate powder with epoxy crosslinker.

Strength of Glass Fiber Web

The strength of the glass fiber web was judged by hand and rated according to the following scheme:

1=very good; 2=good; 3=unsatisfactory; 4=poor.

The test results are summarized in Table 1:

The results of Table 1 show the improvement in fiber binding on using the combination of components a) and b) compared with fiber binding using only binding agent a). Traditional crosslinkable binding agent combinations were used as control in Comparative Examples 15 to 21. The combination of the invention is superior to traditional binding agents utilizing an epoxy crosslinker (Comparative Examples 15 to 18), traditional masked crosslinker systems (Comparative Example 19) and epoxy crosslinkable binding agents without protective colloid.

TABLE 1

| Example | Component a) Amount | Component b) (Amount) | pH | Rating |
|---|---|---|---|---|
| C1 | Powder 1 (0.25 g) | | 8 | 4 |
| 2 | Powder 1 (0.25 g) | Borax (0.0025 g) | 8 | 2 |
| 3 | Powder 1 (0.25 g) | Borax (0.0125 g) | 8 | 2 |
| 4 | Powder 1 (0.25 g) | Borax (0.025 g) | 8 | 2 |
| 5 | Powder 1 (0.05 g) | Borax (0.25 g) | 8 | 2 |
| C6 | Powder 2 (0.25 g) | | 7 | 3 |
| 7 | Powder 2 (0.25 g) | Borax (0.0025 g) | 8 | 2–3 |
| 8 | Powder 2 (0.25 g) | Borax (0.0125 g) | 8 | 2 |
| C9 | Powder 3 (0.25 g) | | 5 | 3 |
| 10 | Powder 3 (0.25 g) | Borax (0.0025 g) | 8 | 2–3 |
| 11 | Powder 3 (0.25 g) | Borax (0.0125 g) | 8 | 2 |
| C12 | Powder 4 (0.25 g) | | 6 | 3 |
| 13 | Powder 4 (0.25 g) | Borax (0.0025 g) | 8 | 2–3 |
| 14 | Powder 4 (0.25 g) | Borax (0.0125 g) | 8 | 1–2 |
| C15 | Powder 1 (0.25 g) | Glyoxal (0.0025 g) | 3.5 | 3–4 |
| C16 | Powder 1 (0.25 g) | Glyoxal (0.0125 g) | 4.7 | 3–4 |
| C17 | Powder 1 (0.25 g) | Glyoxal (0.025 g) | 4.8 | 3–4 |
| C18 | Powder 1 (0.25 g) | Glyoxal (0.05 g) | 4.9 | 3–4 |
| C19 | Powder 5 (0.25 g) | $AlCl_3$ (0.0125 g) | 4 | 3 |
| C20 | Powder 6 (0.25 g) | | 6 | 4 |
| C21 | Powder 6 (0.25 g) | Borax (0.025 g) | 8 | 4 |

The binding force of the fiber binding powder composition was tested in formed fiber products:

Fiber Binding Powder Compositions Tested

EXAMPLE 22

950 g of polymer powder 1 (vinyl acetate polymer with 1% by weight of N-methylolacrylamide, stabilized with 8% by weight of polyvinyl alcohol (Höppler viscosity 25 mPas; degree of hydrolysis 92%)) were mixed with 50 g of borax in a plowshare mixer.

EXAMPLE 23

950 g of polymer powder 1 were mixed with 50 g of aluminum trichloride hexahydrate in a plowshare mixer.

COMPARATIVE EXAMPLE 24

Polymer powder 1 was used without component b).

Fabrication of Formed Fiber Products

To produce hardboard, 118 g of cotton shoddy were mixed with 13.2 g of binding powder from Inventive Examples 22 and 23 and Comparative Example 24 and spread out to cover an area of 30×30 cm. The fiber/powder mixtures were then moistened with water (by spraying) and immediately thereafter pressed for 5 minutes at temperatures of about 180° C. and at pressures of about 36 bar to produce boards 2 mm in thickness and 1390 g/m$^2$ in weight.

EXAMPLE 25

The formed fiber products were fabricated using only polymer powder 1 as fiber binder, but spraying with a 5% strength zirconium acetate solution instead of with water.

Test Methods

Testing the Ultimate Tensile Strength UTS

Specimens measuring 10×100 mm were stamped out of the press formed fiber products and tested at room temperature on a Zwick tensile tester in accordance with DIN 53857.

Testing the Water Absorption

Formed fiber products measuring 50×20 mm were stored in water for 1 h or 24 h and the weight increase due to water swelling was determined gravimetrically.

Testing the Heat Resistance

Strips 240×20 mm in length were cut from the formed fiber products and fixed horizontally on a planar surface with an overhang of 100 mm beyond the edge of the surface and weighted with a 40 g load. The heat resistance was determined by measuring the deflection, d, after one hour at T=120° C. The deflection d is the amount by which the end of the strip which is 100 mm away from the surface deflects under the load.

The test results are summarized in Table 2:

TABLE 2

| Example | UTS [N] | Water absorption [%] | Heat resistance [mm] |
|---|---|---|---|
| 22 | 954 | 59 | 22.0 |
| 23 | 964 | 59 | 21.0 |
| C24 | 630 | 59 | 31.0 |
| 25 | 1081 | 57 | 23.5 |

The test results of Table 2 clearly show the improvement in the mechanical strength ("UTS", ultimate tensile strength, heat resistance) on using the fiber binding powder composition compared with binding powder without component b) (Comparative EXAMPLE 24).

What is claimed is:

1. A process for consolidating fiber materials, said process comprising 1) contacting fiber materials with a binder composition comprising:
   a) a polymer powder comprising a stabilized polymer of one or more monomers selected from the group consisting of vinyl esters of branched or unbranched carboxylic acids having 1 to 12 carbon atoms, esters of acrylic acid and methacrylic acid with branched or unbranched alcohols having 1 to 12 carbon atoms, aromatic vinyl compounds, vinyl halides, olefins and dienes, and mixtures thereof, said stabilized polymer (s) stabilized by a polyvinyl alcohol stabilizer having a Höppler viscosity, measured as a 4% aqueous solution at 20° C., of 1 mPa·s to 60 mPa·s; and
   b) an inorganic compound which is solid at room temperature and which enters into a chemical bond with the OH groups of the polyvinyl alcohol on introduction of said powder into water;

wherein said composition following contact with water has a pH of about 8;

2) contacting said components a) and b) with water, said contacting taking place prior to step 1), during step 1), following step 1, or any combination thereof, to form a consolidatable product;
3) drying and consolidating the consolidatable product of step 2 at a temperature in excess of 80° C.

2. The process of claim 1, wherein component a) comprises one or more polymers powder based on polyvinyl alcohol stabilized polymer(s) selected from the group consisting of vinyl acetate polymers, vinyl acetate-ethylene copolymers having an ethylene content of 1 to 60% by weight, vinyl ester-ethylene-vinyl chloride copolymers having an ethylene content of 1 to 40% by weight and a vinyl chloride content of 20 to 90% by weight, vinyl acetate copolymers with 1 to 50% by weight of one or more copolymerizable vinyl esters and optionally 1 to 40% by weight of ethylene, vinyl ester-acrylic ester copolymers containing 30 to 90% by weight of vinyl ester and 1 to 60% by weight of acrylic ester and optionally 1 to 40% by weight of ethylene, vinyl ester-acrylic ester copolymers containing 30 to 75% by weight of vinyl acetate and 1 to 30% by weight of other vinyl esters and optionally 1 to 40% by weight of ethylene, polymers of n-butyl acrylate or 2-ethylhexyl acrylate, copolymers of methyl methacrylate with n-butyl acrylate and/or 2-ethylhexyl acrylate, vinyl chloride-ethylene copolymers, vinyl chloride-acrylate copolymers, styrene-butadiene copolymers and styrene-acrylic ester copolymers having a styrene content of 10 to 70% by weight in each case.

3. The process of claim 1, wherein said polymer additionally contains 0.05 to 10.0% by weight, based on the total weight of the monomers, of comonomers selected from the group consisting of ethylenically unsaturated mono- and dicarboxylic acids and their amides, ethylenically unsaturated sulfonic acids and their salts, acryloyloxy-propyltri (alkoxy)- and methacryloyloxypropyltri(alkoxy)-silanes, vinyltrialkoxysilanes and vinyl-methyldialkoxysilanes, N-methylolacrylamide, N-methylolmethacrylamide, N-methylolallylcarbamate, alkyl ethers of N-methylolacrylamide or N-methylolmethacrylamide and their isobutoxy ethers or n-butoxy ethers, and mixtures thereof.

4. The process of claim 2, wherein the polyvinyl alcohol is a partially hydrolyzed polyvinyl alcohol having a degree of hydrolysis of 75 to 99 mol % and a Höppler viscosity of 4 to 35 mPas.

5. The process of claim 3, wherein the polyvinyl alcohol is a partially hydrolyzed polyvinyl alcohol having a degree of hydrolysis of 75 to 99 mol % and a Höppler viscosity of 4 to 35 mPas.

6. The process of claim 1, wherein component b) is an inorganic compound selected from the group consisting of water-soluble compounds of boron, aluminum, chromium and zirconium, or mixtures thereof, which are pulverulent at room temperature and whose solubility in water under standard conditions is not less than 1 g per liter of water.

7. The process of claim 2, wherein component b) is an inorganic compound selected from the group consisting of water-soluble compounds of boron, aluminum, chromium and zirconium, or mixtures thereof, which are pulverulent at room temperature and whose solubility in water under standard conditions is not less than 1 g per liter of water.

8. The process of claim 1, wherein component b) is an inorganic compound selected from the group consisting of boric acid, borax, boric acid complexes of bi- and more highly valent ligands, aluminum nitrate, aluminum chloride, zirconium oxychloride, zirconium acetate, and mixtures thereof.

9. The process of claim 1, wherein said binder composition further comprises a pulverulent, water-soluble substance as a pH buffer.

10. The process of claim 2, wherein said binder composition further comprises a pulverulent, water-soluble substance as a pH buffer.

11. The process of claim 1, wherein the polyvinyl alcohol is a partially hydrolyzed polyvinyl alcohol having a degree of hydrolysis of 75 to 99 mol % and a Höppler viscosity of 4 to 35 mPas.

12. A process for consolidating fiber materials, said process comprising 1) contacting fiber materials with a binder composition comprising:
   a) a polymer powder comprising a stabilized polymer of one or more monomers selected from the group consisting of vinyl esters of branched or unbranched carboxylic acids having 1 to 12 carbon atoms, esters of acrylic acid and methacrylic acid with branched or unbranched alcohols having 1 to 12 carbon atoms, aromatic vinyl compounds, vinyl halides, olefins and dienes, and mixtures thereof, said stabilized polymer (s) stabilized by a polyvinyl alcohol stabilizer having a Höppler viscosity, measured as a 4% aqueous solution at 20° C., of 1 mPa·s to 60 mPa·s; and b) an inorganic compound which is solid at room temperature and which enters into a chemical bond with the OH groups of the polyvinyl alcohol on introduction of said powder into water wherein said binder composition is free of masked aldehydes;

2) contacting said components a) and b) with water, said contacting taking place prior to step 1), during step 1), following step 1, or any combination thereof, to form a consolidatable product;

3) drying and consolidating the consolidatable product of step 2 at a temperature in excess of 80° C.

13. The process of claim 12, wherein component a) comprises one or more polymers powder based on polyvinyl alcohol stabilized polymer(s) selected from the group consisting of vinyl acetate polymers, vinyl acetate-ethylene copolymers having an ethylene content of 1 to 60% by weight, vinyl ester-ethylene-vinyl chloride copolymers having an ethylene content of 1 to 40% by weight and a vinyl chloride content of 20 to 90% by weight, vinyl acetate copolymers with 1 to 50% by weight of one or more copolymerizable vinyl esters and optionally 1 to 40% by weight of ethylene, vinyl ester-acrylic ester copolymers containing 30 to 90% by weight of vinyl ester and 1 to 60% by weight of acrylic ester and optionally 1 to 40% by weight of ethylene, vinyl ester-acrylic ester copolymers containing 30 to 75% by weight of vinyl acetate and 1 to 30% by weight of other vinyl esters and optionally 1 to 40% by weight of ethylene, polymers of n-butyl acrylate or 2-ethylhexyl acrylate, copolymers of methyl methacrylate with n-butyl acrylate and/or 2-ethylhexyl acrylate, vinyl chloride-ethylene copolymers, vinyl chloride-acrylate copolymers, styrene-butadiene copolymers and styrene-acrylic ester copolymers having a styrene content of 10 to 70% by weight in each case.

14. The process of claim 12, wherein said polymer additionally contains 0.05 to 10.0% by weight, based on the total weight of the monomers, of comonomers selected from the group consisting of ethylenically unsaturated mono- and dicarboxylic acids and their amides, ethylenically unsaturated sulfonic acids and their salts, acryloyloxy-propyltri(alkoxy)- and methacryloyloxypropyltri(alkoxy)-silanes, vinyltrialkoxysilanes and vinyl-methyldialkoxysilanes, N-methylolacrylamide, N-methylolmethacrylamide, N-methylolallyl-carbamate, alkyl ethers of N-methylolacrylamide or N-methylolmethacrylamide and their isobutoxy ethers or n-butoxy ethers, and mixtures thereof.

15. The process of claim 12, wherein the polyvinyl alcohol is a partially hydrolyzed polyvinyl alcohol having a degree of hydrolysis of 75 to 99 mol % and a Höppler viscosity of 4 to 35 mPas.

16. The process of claim 12, wherein component b) is an inorganic compound selected from the group consisting of water-soluble compounds of boron, aluminum, chromium and zirconium, or mixtures thereof, which are pulverulent at room temperature and whose solubility in water under standard conditions is not less than 1 g per liter of water.

17. The process of claim 12, wherein component b) is an inorganic compound selected from the group consisting of boric acid, borax, boric acid complexes of bi- and more highly valent ligands, aluminum nitrate, aluminum chloride, zirconium oxychloride, zirconium acetate, and mixtures thereof.

* * * * *